US007628203B2

(12) United States Patent
Mouget et al.

(10) Patent No.: US 7,628,203 B2
(45) Date of Patent: Dec. 8, 2009

(54) TRACER INJECTOR TOOL FOR WELL INVESTIGATION

(75) Inventors: Pierre Mouget, Sevres (FR); Jean-Francois Sandoz, Paris (FR); Philippe Boucher, Nogent le Roi (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 102 days.

(21) Appl. No.: 10/596,814

(22) PCT Filed: Dec. 1, 2004

(86) PCT No.: PCT/EP2004/013681

§ 371 (c)(1),
(2), (4) Date: Jun. 26, 2006

(87) PCT Pub. No.: WO2005/064115

PCT Pub. Date: Jul. 14, 2005

(65) Prior Publication Data

US 2007/0144737 A1 Jun. 28, 2007

(30) Foreign Application Priority Data

Dec. 31, 2003 (EP) ..... 03293353

(51) Int. Cl.
*E21B 47/00* (2006.01)

(52) U.S. Cl. ..... 166/250.12; 166/250.01

(58) Field of Classification Search ..... 166/250.12, 166/250.01, 250.03
See application file for complete search history.

(56) References Cited

U.S. PATENT DOCUMENTS

| | | | | |
|---|---|---|---|---|
| 6,017,198 | A * | 1/2000 | Traylor et al. | 417/390 |
| 2003/0056952 | A1 * | 3/2003 | Stegemeier et al. | 166/250.12 |
| 2003/0164240 | A1 * | 9/2003 | Vinegar et al. | 166/372 |

* cited by examiner

*Primary Examiner*—Jennifer H Gay
*Assistant Examiner*—Brad Harcourt
(74) *Attorney, Agent, or Firm*—Darla Fonseca; Jaime Castano; Dale Gaudier

(57) ABSTRACT

A tool system for monitoring a flow of liquid within a borehole. The tool system comprises a plurality of tools disposed on a longitudinal axis of the tool system. The plurality of tools comprises at least a first injector tool for ejecting in the borehole a tracer and a detector tool to detect the ejected tracer. The tool system further comprises a standard digital bus traversing at least a portion of each tool of the plurality of tools. The standard digital bus allows a communication between each tool of the plurality of tools.

13 Claims, 6 Drawing Sheets

TRACER INJECTOR TOOL FOR WELL INVESTIGATION

BACKGROUND OF INVENTION

1. Field of the Invention

The invention relates generally to downhole injection of one or more tracers or marker materials in a well.

2. Background Art

When a well, specifically an oil or gas well, has been completed and is yielding a desired product, it is necessary to monitor the well's performance to ensure that it is behaving as expected. In particular, it is desirable to measure a velocity of a fluid along a borehole and up to the surface. In an oil well, the fluid may be oil, water, gas or a combination, even a mixture, of all three. It is generally desirable to monitor the velocities of the fluids actually down the well itself rather than merely when they reach the surface.

Many types of method and apparatus have been proposed for this purpose. A first method involves the use of a mechanical "spinner" a wireline-supported tool carrying a small propeller- (or turbine-) driven dynamo is placed in a flowing fluid so that the propeller is turned around by it, and the dynamo's output indicates the velocity of the flowing fluid. The first method provides satisfactory results in borehole sections that are vertical, but not in sections which are horizontal. A horizontal section may indeed comprise several layers, e.g. an oil layer above a water layer.

A second method involves an injector/detector tool that injects a small amount of tracer e.g., a detectable chemical or a radioactive substance, at a first location and detects the injected tracer at a second location. The flow velocity is calculated by a simple distance over time calculation. An example of injector/detector tool is the Tracer Injector tool of Schlumberger which is described in U.S. Pat. Nos. 4,166,215 and 4,166,216. The U.S. Pat. No. 6,125,934 describes an injector tool adapted for a horizontal section. For a determined tracer intended to be ejected into a corresponding layer, the injector tool comprises an ejection port that is oriented such that the determined tracer may be ejected directly into the corresponding layer. Hence an oil miscible tracer is injected into an oil layer and a water miscible tracer is injected into a water layer.

FIG. 1 illustrates a typical injector/detector tool known from prior art. An injector tool 101 ejects a tracer into a borehole 102 at a first location (not shown in FIG. 1), and a detector tool 103 detects the tracer at a second location (not shown in FIG. 1). The ejection of the tracer is commanded via a command wire 106 that controls from a surface system 111 located at the surface a solenoid valve 105 of the injector tool. When the switch is on, the solenoid valve 105 is open and a relatively constant force acting on a piston 107 due to a spring 104 expels an amount of the tracer through a thin tube 112.

FIG. 1 illustrates a system as it is being used in a vertical well. However, such a system may also be used in a horizontal well. For this purpose, it may further comprise an ejection port that is judicially oriented to aim a determined layer.

A dedicated wire 108 transmits an analog signal to activate the detector tool 103, thus allowing to detect the tracer. When activated, the detector tool transmits results to the surface system 111 via a results wire 115. The electrical wires (106, 108, 115) are located within a central chamber 113 so as to be protected from any liquid. The central chamber 113 may also contain one or more additional wires that are used for a communicating between the surface system 111 and one or more additional devices, e.g. a logging device 109.

In the system illustrated in FIG. 1, the tracer is directly ejected from a reservoir 114. The quantity of tracer that is discharged into the borehole 102 is determined by a duration of the opening of the solenoid valve 105, the duration being controlled at surface. However, it is not possible to insure that the quantity of tracer corresponding to the duration has effectively been ejected.

In another system from prior art, the quantity of tracer that is periodically discharged into the borehole space is determined by a size of a syringe filled with the tracer before ejection. The tracer may be stored in a reservoir that communicates with the syringe so as to provide a regular filling of the syringe. A Hall Effect sensor may detect the end of stroke of the piston so as to confirm that the quantity of tracer has been ejected.

When a piece of the injector tool has to be replaced, e.g., the reservoir 114, the injector tool needs to be completely stripped out. It is indeed necessary to cut electrical wires located in the central chamber 113 to remove the piece.

Similarly, the electro-valve 105 comprises a solenoid coil 117 communicating with the command wire 106, and a solenoid seat 118 through which the tracer is expelled. The solenoid coil 117 is used to control a movement of a plunger 119 that allows the tracer to be expelled. When the solenoid seat 118 is replaced, the solenoid coil also needs to be removed.

SUMMARY OF INVENTION

In a first aspect the invention provides a tool system for monitoring a flow of liquid within a borehole. The tool system comprises a plurality of tools disposed on a longitudinal axis of the tool system. The plurality of tools comprises at least a first injector tool for ejecting in the borehole a tracer and a detector tool to detect the ejected tracer. The tool system further comprises a standard digital bus traversing at least a portion of each tool of the plurality of tools. The standard digital bus allows a communication between each tool of the plurality of tools.

In a first preferred embodiment, the plurality of tools comprises a control tool to manage data exchanges through the standard digital bus.

In a second preferred embodiment, the plurality of tools comprises a second injector tool located on an opposite side of the detector tool of the tool system as compared to the first injector tool so as to allow to detect a possible reverse flow in the borehole.

In a third preferred embodiment, plurality of tools also comprises a third injector tool distinct from the first injector tool. The third injector tool is located on the same side of the detector tool in the tool system as the first injector tool.

In a fourth preferred embodiment, the borehole has a longitudinal direction that is substantially horizontal. The plurality of tools also comprises an orientating tool to measure an orientation of at least an ejection port of the first injector tool.

In a fifth preferred embodiment, the first injector tool comprises a first group of electrical wires corresponding to the standard digital bus and at least one standard connector. The at least one standard connector allows to removably connect the first group of electrical wires to a second group of electrical wires corresponding to the standard digital bus within a distinct tool from the plurality of tools.

In a sixth preferred embodiment, both the first group of electrical wires and the second group of electrical wires comprise two power wires dedicated to power transportation and two signal wires dedicated to signal transportation.

In a second aspect, the invention provides a method for monitoring a flow of liquid within a borehole. The method comprises providing a plurality of tools on a longitudinal axis of the borehole. The tools are linked with a standard digital bus allowing a communication between each tool of the plurality of tools. A quantity of tracer is ejected using a first injector tool among the plurality of tools. The ejected tracer is detected using a detector tool among the plurality of tools.

In a seventh preferred embodiment, the method further comprises managing data exchanges through the standard digital bus using a control tool among the plurality of tools.

In an eighth preferred embodiment, a possible reverse flow in the borehole is detected using a second injector tool among the plurality of tools. The second injector tool is located on an opposite side of the detector tool as compared to the first injector tool. The second injector tool communicates with the detector tool using the standard digital bus.

In a ninth preferred embodiment, an orientation of at least an ejection port of the first injector tool is measured with an orientating tool among the plurality of tools.

In a third aspect, the invention provides an injector tool for ejecting a tracer in a system for monitoring a flow of liquid within a borehole. The injector tool comprises measuring means to measure an ejected quantity of the ejected tracer.

In a tenth preferred embodiment, the injector tool further comprises a body and a piston to expel the tracer. The measuring means measure a displacement of the piston relative to the body.

In an eleventh preferred embodiment, the measuring means comprise at least one magnetic ring mounted on the piston, and a plurality of Hall effect switches mounted on the body.

In a twelfth preferred embodiment, three magnetic rings are mounted on the piston. The Hall Effect switches are organized into four independent arrays. The Hall Effect switches belonging to a determined array are tied to a single determined wire.

In a thirteenth preferred embodiment, the injector tool further comprises a reservoir into which the tracer is stored, an opening through which the tracer may be ejected from the injector tool and an electro-valve to control the opening. The injector tool further comprises actuating means. The actuating means allow to move the piston such that the piston moves when the electro-valve opens the opening and the tracer is ejected.

In a fourth aspect, the invention provides a tool system for monitoring a flow of liquid within a borehole comprising an injector tool according to the second aspect of the invention.

In a fifth aspect, the invention provides a method for monitoring a flow of liquid within the borehole. The method comprises ejecting a tracer with an injector tool located within the borehole. The method further comprises measuring an ejected quantity of the ejected tracer.

In a fourteenth preferred embodiment, the ejected tracer is detected with a detector tool located within the borehole.

In a fifteenth preferred embodiment, a value of a desired quantity of tracer is received downhole. The method further comprises starting the ejecting of the tracer, comparing the measured ejected quantity of tracer with the value of the desired quantity and interrupting the ejecting if measured ejected quantity substantially equals the value of the desired quantity.

In a sixteenth preferred embodiment, a counter is initialized at the starting of the ejecting. The counter is incremented while the tracer is being ejected. A value of the counter is transmitted to a surface system at the interrupting of the ejection. The value of the counter is a function of a duration of the ejecting.

In a sixth aspect, the invention provides an injector tool for ejecting a tracer in a system for monitoring a flow of liquid within a borehole. The injector tool comprises a first group of hydraulic parts intended to be in contact with the tracer and a second group of electrical elements. The hydraulic parts of the first group may be accessed and replaced during a maintenance operation. The electrical elements of the second group remain protected during the maintenance operation.

In a seventeenth preferred embodiment, the injector tool further comprises an electro-valve. The electro-valve comprises an electrical portion belonging to the second group, a solenoid seat belonging to the first group and a high pressure barrier. The high pressure barrier allows to isolate the electrical portion of the electro-valve from the solenoid seat. The electro-valve is mounted in the injector tool such that the solenoid seat may be accessed without removing the electrical portion.

In a eighteenth preferred embodiment, the injector tool further comprises electrical wires belonging to the second group, and a connector. The connector allows to connect the electrical elements of the second group with other electrical elements of a distinct tool. The connector comprises a first portion and a second portion. The first portion may be removed during the maintenance operation. The second portion continues to protect the electrical wires during the maintenance operation.

In a nineteenth, preferred embodiment, an injection counter is activated at the ejecting of the tracer. The injection counter is incremented at an acquisition frequency that is independent from a communication frequency of the communication between the plurality of tools. A value of the injection counter may be read to evaluate a time duration between the ejecting and the detecting.

Other aspects and advantages of the invention will be apparent from the following description and the appended claims.

DETAILED DESCRIPTION

Prior Art

Figure 1:
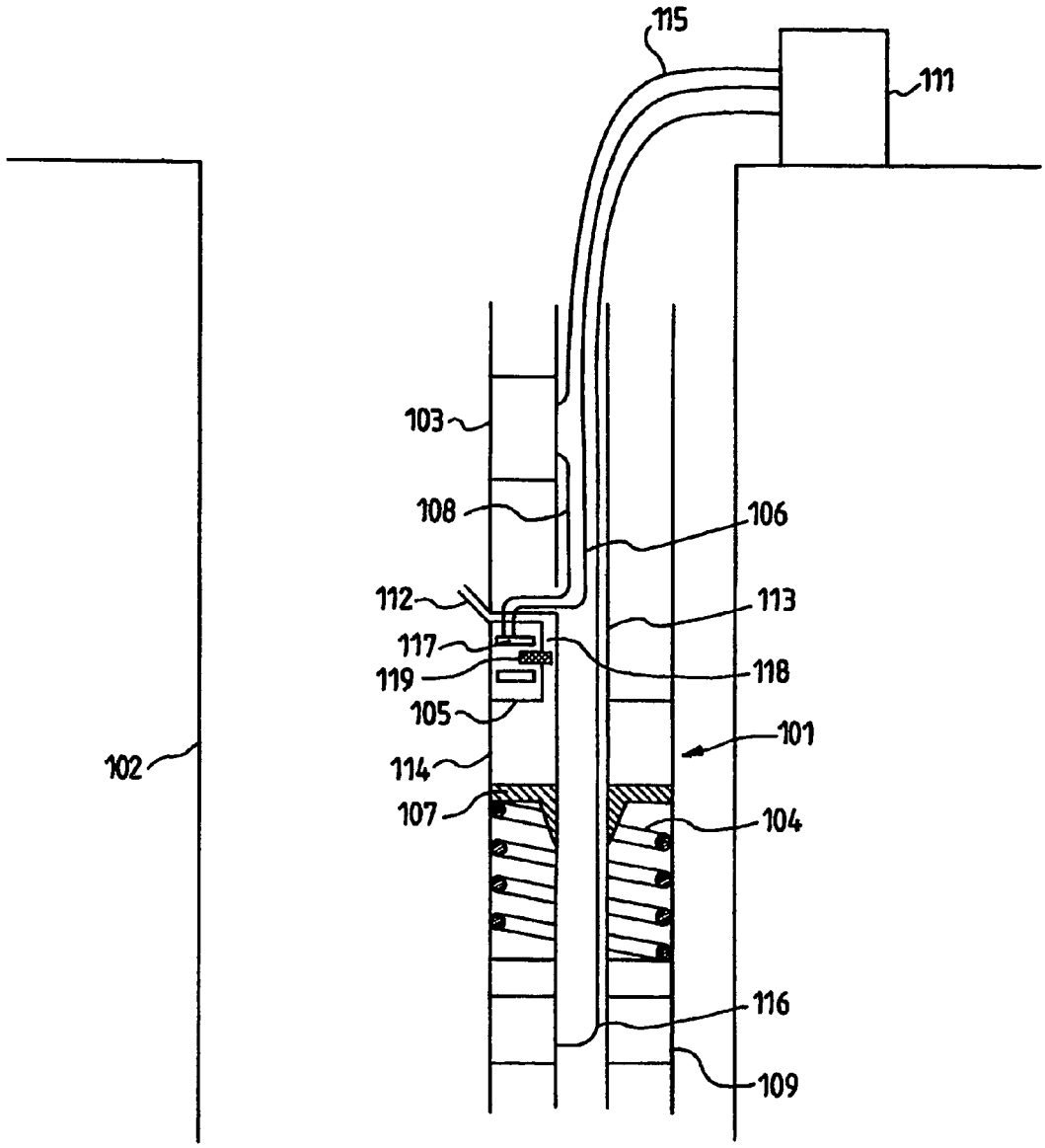
PRIOR ART FIG.1
FIG. 1 illustrates a schematic of an injector/detector tool within a borehole from Prior Art.

The ejector/detector tool from prior art encloses a dedicated wire to insure a synchronization between the injector tool and the detector tool at the ejecting of the tracer. An analog signal activates the detector for a possible detecting of the tracer. If intermediate tools are located between the injector tool and the detector tool, the dedicated wire has to run through all the intermediate tools, which adds an additional cabling to an intermediate cabling of the intermediate tools. Hence, the injector tool may not be easily set anywhere.

It may happen that a casing of the borehole is damaged by a hole, thus causing losses of fluids through the hole. A water producing zone above the hole may generate a reverse flow. A possible way to detect the presence of the hole is to measure a velocity of the reverse flow in the borehole. The reverse flow may also be caused by a recirculation of water in a horizontal well. In both cases, a production rate of the well is affected. The reverse flow may be monitored by ejecting a tracer at a first location with an injector tool and by providing a detector tool at a second location, the second location being located deeper within the borehole than the first location. In a case of a lateral hole, the second location is located further from a main well than the first location.

However, the detector tools as known in the art are not able to manage several analog signals from several dedicated wires: a multiple injector tools—single detector tool configuration is not possible. Therefore, the detecting of the reverse flow requires providing a dedicated detector tool.

A system allowing a synchronization of an injector tool with a detector tool without such a dedicated wire may render the multiple injector tools—single detector tool configuration possible. There is thus a need such a synchronization without the dedicated wire so as to allow to detect the reverse flow without providing a dedicated detector tool.

Furthermore, the quantity of tracer that is periodically discharged into the borehole is predetermined. It may occur that the predetermined quantity is too small to allow a proper detection of the tracer. Or, on the contrary, the predetermined quantity may be so high that a recharging of the reservoir is frequently required. There is a need for a system in which the ejected quantity of tracer may be commanded and changed from the surface.

When a piece of the injector tool has to be replaced, it is necessary to intervene on an electrical element thereof. For example, if a solenoid seat of the electro-valve needs to be replaced, it is necessary to intervene on a solenoid coil. Electrical wires located in a central chamber also have to be cut when a piston is replaced. Most maintenance operations on the injector tool may hence be relatively long. For example, it may take two hours for replacing the electro-valve. There is a need for a system in which the pieces may be replaced more rapidly.

Standard Digital Bus Tracer Injector Tool

Figure 2:
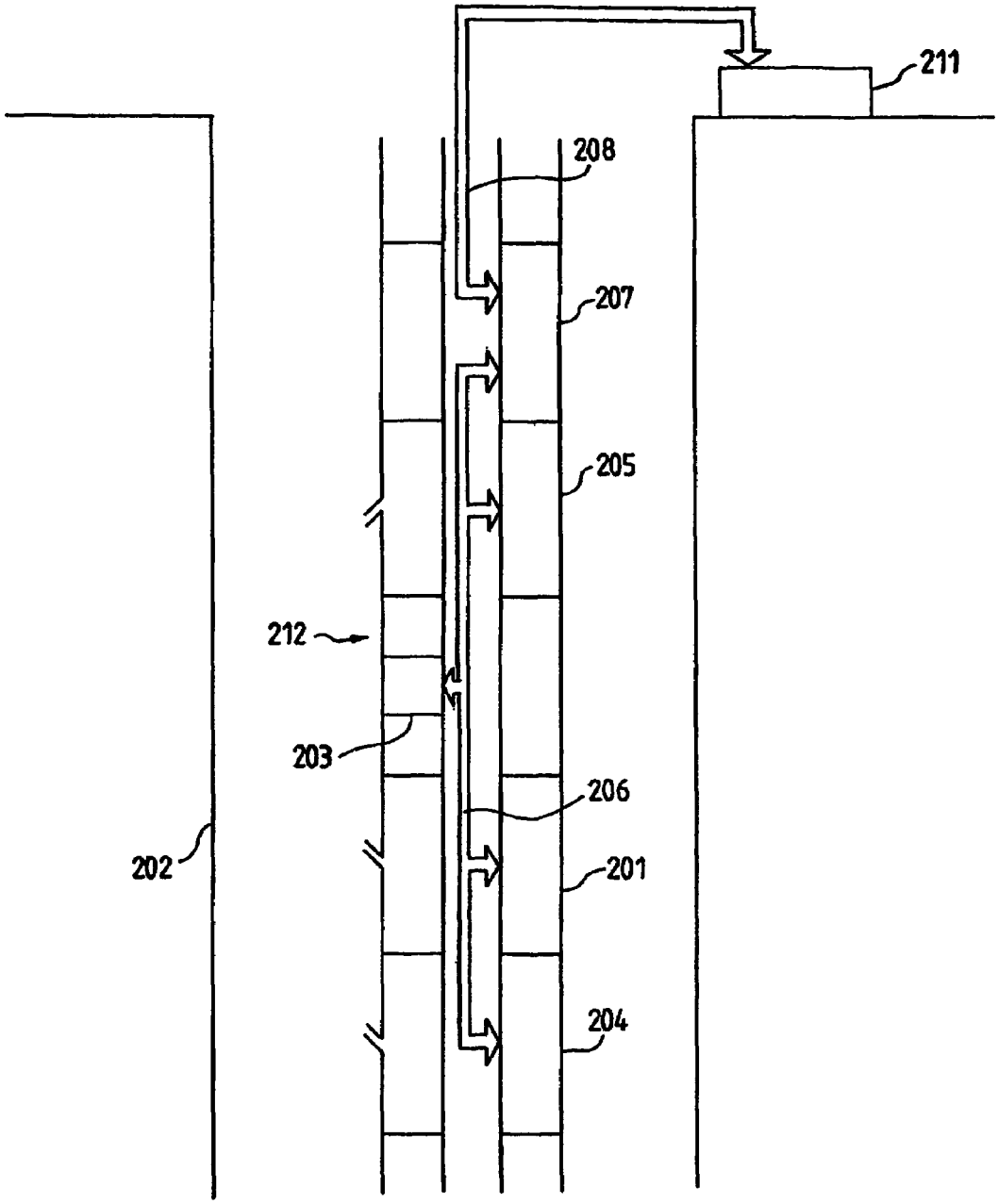
FIG. 2 illustrates an example of a tool system according to the present invention.

FIG. 2 illustrates an example of a tool system for monitoring a flow of liquid within a borehole according to the invention. A plurality of tools (201, 203, 204, 205, 207) is disposed on a longitudinal axis of a tool system 212 within a borehole 202. In this example, the tools are assembled to form a tube. The plurality of tools (201, 203, 204, 205, 207) comprises at least a first injector tool 201 for ejecting in the borehole 202 a tracer and a detector tool 203 to detect the ejected tracer. A standard digital bus 206 traverses longitudinally at least a portion of each tool of the plurality of tools (201, 203, 204, 205, 207). The standard digital bus 206 allows a communication between each tool of the plurality of tools (201, 203, 204, 205,207).

In the example illustrated in FIG. 2, a control tool 207 manages data exchanges through the standard digital bus 206. The control tool 207 in addition communicates with a surface system 211 through a surface bus 208.

In the systems from prior art wherein a dedicated wire is required between an injector tool and a detector tool, it may be relatively delicate to provide an additional tool between the injector tool and the detector tool. For this reason, the injector tool is usually disposed at a relatively low distance from the detector tool. Because no dedicated wire is required for synchronization, the system according to the invention allows to dispose the injector tool at a greater distance from the detector tool than the systems from prior art. The measurements of the flow velocity may thus be more accurate.

The standard digital bus 206 allows to insure the synchronization. Preferably, an ejection counter (not represented) is activated at the ejecting of the tracer. The activating of the ejection counter allows to activate at least the detector tool 203. The ejection counter is incremented at an acquisition frequency that is independent from a communication frequency of the communication between the plurality of tools (201, 203, 204, 205, 207). The acquisition frequency may have a relatively high value, e.g. 15 kHz. The communication frequency at which the plurality of tools (201, 203, 204, 205, 207) communicates may be smaller than the acquisition frequency and may vary with time. Typically, the communication frequency may be smaller than 5 Hz. The ejection counter hence allows to evaluate a time duration between the ejecting and the detecting of the tracer with a relatively high precision. A value of the injection counter may be read to evaluate the time duration between the ejecting and the detecting.

Alternatively, the synchronization may be performed by broadcasting a single ejection command to both the first injector tool 201 and the detector tool 203.

The standard digital bus 206 may also be used to allow a communication with a second injector tool 205 located opposite the detector tool 203 when seen from the first injector 201, so as to allow to detect a possible reverse flow in the borehole 202.

The plurality of tools may also comprise a third injector tool 204 distinct from the first injector tool 201, the third injector tool 204 being located on the same side of but more distant from the detector tool 203. The third injector tool 204 may eject the same type of tracer as the first injector tool 201. Because of a greater distance between the third injector tool 204 and the detector tool 203, and because the detector tool 203 detects tracer ejected at different locations, a better accuracy of the measuring of the flow velocity is thus provided.

The third injector tool 204 may also eject a second tracer different from the tracer ejected by the first injector tool 201. For example, the second tracer may be an oil tracer, intended to coalesce with an oil phase, whereas the tracer ejected by the first injector tool 201 may be a water tracer intended to coalesce with a water or brine phase. Hence the flow velocities of both the oil phase and the water phase are measured using a single detector tool.

In a further example embodiment (not represented in FIG. 2), the well is horizontal; the first injector tool and the third injector tool may comprise an ejection port. For example, the ejection port of the first injection tool may be oriented downward so as to inject a water or brine tracer, and the ejection port of the third ejection tool may be oriented upward so as to eject an oil tracer.

In the system according to the invention, there is no dedicated wire through which an analog signal activates the detector tool as in prior art, and hence no wire related constraints for placing the injector tools.

The system according to the invention allows a multiple injector tools—single detector tool configuration, unlike the systems from prior art. The detector tools is not required to manage several analog signals from several dedicated wires coming from several ejector tools as is the case with the systems from prior art. By providing a standard digital bus 206 between each of the plurality of tools (201, 203, 204, 205, 207), the invention allows more than a single injector tool for a single detector.

Furthermore, the system according to the invention provides compatibility between the injector tools and any other downhole tool that uses the standard digital bus to communicate. In particular, in a case of a horizontal section, where a first injector tool having an ejection port oriented to lay with a determined layer is used, the first injector tool may be able to communicate with an orientating tool. The orientating tool may for example comprise a relative bearing measuring tool. The orientating tool may also comprise absolute angle measuring means, thus providing a reliable measurement of an orientation of the ejection port. Furthermore, the orientating tool may comprise a probe that is able to evaluate a nature of the determined layer (oil, water . . . ). Hence such an orientating tool provides various measurements that may be crucial for monitoring correctly a flow of liquid of the determined layer. The standard digital bus allows the first injector tool and any other tool to communicate with the orientating tool, and to supply both tools with power.

The tools of the plurality of tools, e.g. the first injector tool, may comprise a standard connector. The standard connector of the first injector tool allows a first group of electrical wires corresponding to the standard digital bus along the first injector tool to be removably connected to a second group of electrical wires. The second group of electrical wires corresponds to the standard digital bus along a distinct tool of the plurality of tools, i.e. a tool that is able to communicate using the standard digital bus. The standard connector hence allows to replace one of the tools of the plurality of tools by another, e.g. the first injector tool and the detector tool may be interchanged so as to detect a possible reverse flow. In the systems from prior art, the first injector tools comprises a dedicated connector, and the replacing of one tool by an other is thus more complex.

The standard digital bus may for example be a Production Service Platform bus (PSP). The PSP bus comprises two power wires dedicated to power transportation, and two signal wires dedicated to signal transportation. The standard digital bus may also be any digital bus that allows a communicating between devices.

The plurality of tools comprises at least the first injector tool and the detector tool. The plurality of tools of the present invention may comprise other devices such as logging devices that also communicate using the standard digital bus. The system according to the invention may also comprise some extra tools that communicate using a dedicated wire, or using a second bus distinct from the standard digital bus.

Injector Tool

Figure 3:
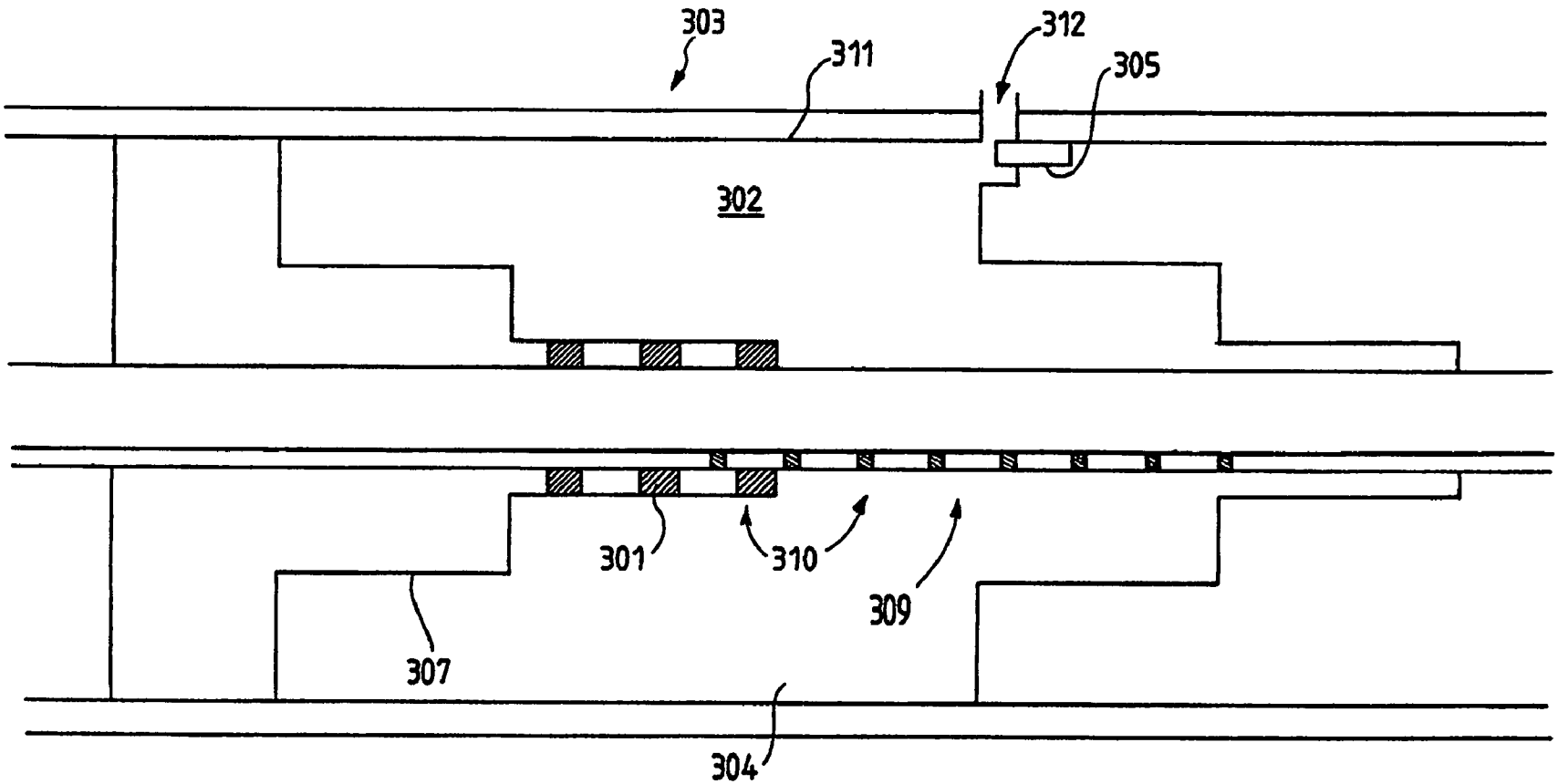
FIG. 3 illustrates an example of a portion of an injector tool according to the present invention.

FIG. 3 illustrates an example of an injector tool for ejecting a tracer in a tool system for monitoring a flow of liquid within a borehole according to the invention. The injector tool 303 comprises measuring means 310 to measure an ejected quantity of the ejected tracer.

The measuring means 310 may, as represented in FIG. 3, be located within the injector tool 303. As the tracer 302 stored into a reservoir 304 is typically expelled by a displacement of a piston 307, the measuring means 310 may measure a displacement of the piston 307 relative to a body 311 of the injector tool 303. An electro-valve 305 controls an opening 312 through which the tracer may be ejected from the injector tool 303. During an ejection operation, actuating means, e.g. a spring (not represented on FIG. 3) move the piston 307 when the electro-valve 305 opens the opening 312 and the tracer is ejected. The measuring means 310 allow to measure the ejected quantity of tracer.

For example, the piston 307 may comprise three magnetic rings 301 that are mounted thereon so as to have a same movement as the piston 307. When the piston 307 slides along the body 311 of the injector tool 303, Hall Effect switches 309 mounted on the body 311 detect a displacement of the magnetic rings 301. Such measuring means that involve the Hall Effect may be designed to avoid any contact between the tracer and themselves. Hence it is possible to use corrosive tracers.

Figure 4:
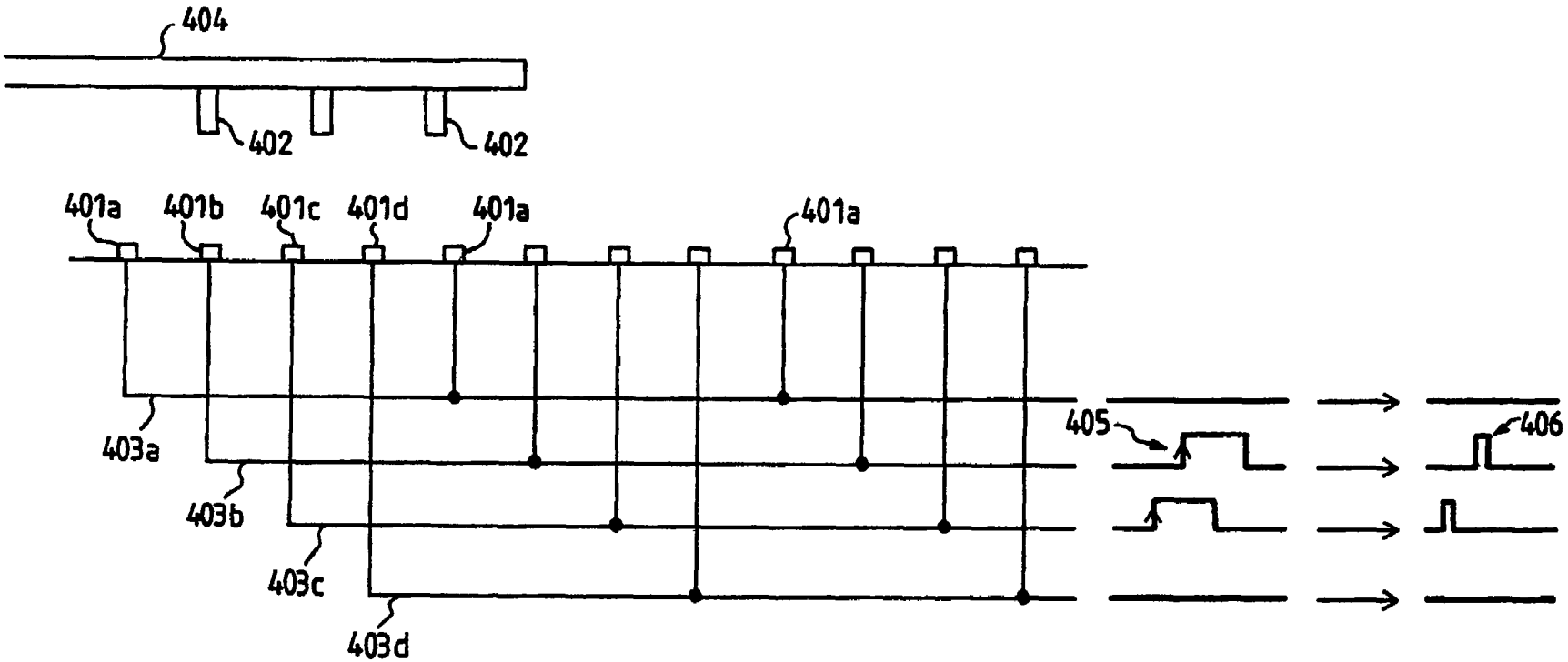
FIG. 4 illustrates measuring means of an injector tool according to a preferred embodiment of the present invention.

FIG. 4 illustrates a preferred embodiment of measuring means according to the present invention. In this embodiment, the Hall Effect switches 401 are organized in four independent arrays. Each array of switches may be longitudinally disposed with a determined azimuthal angle, even if the Hall Effect switches 401 are represented on a same axis on FIG. 4. Each array is tied to a corresponding wire (403*a*, 403*b*, 403*c*, 403*d*). A signal 405 on a determined wire 403*b* is generated by a passage of a magnetic ring 402 close to one of the Hall effect switches 401*b* belonging to the array corresponding to the determined wire 403*b*.

The three magnetic rings 402 located on an extension 404 of a piston are separated from each other by a distance that is 33% higher than a space between two Hall Effect switches, so as to provide a measurement that is three times more accurate than with a single magnetic ring.

The signal 405 may be processed so as to generate a pulse 406 at its rising edge. By observing the pulses corresponding to the four electrical wires, it is possible to measure a relative displacement of the piston relative to the Hall Effect switches.

In another embodiment of the present invention, an absolute displacement of a piston relative to a body may be measured.

Figure 5:
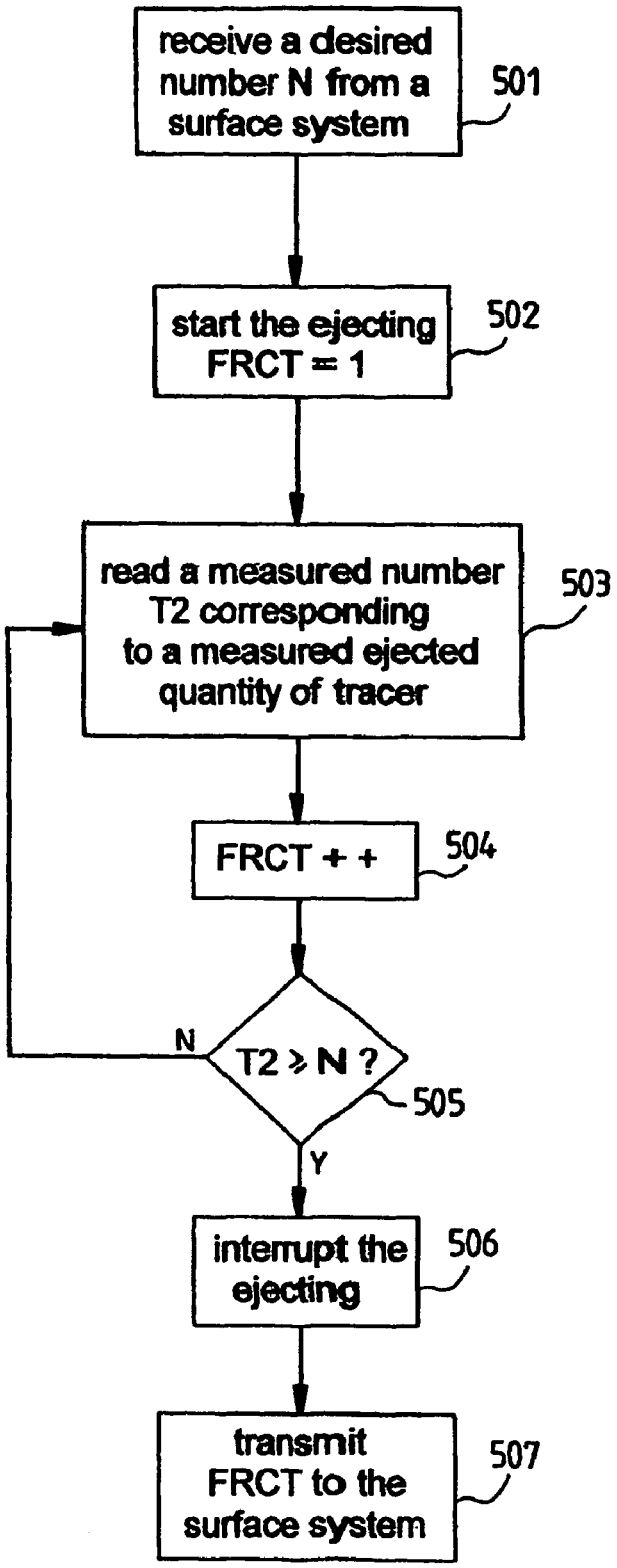
FIG. 5 illustrates an example of an algorithm to be executed by an electronic card of a tool system according to the present invention.

Such a measurement allows to control the ejected quantity of tracer. FIG. 5 illustrates an example of an algorithm to be executed by an electronic card downhole. The electronic card may be part of a tool system comprising the injector tool and a detector tool, the detector tool allowing to detect the ejected tracer. A desired number N corresponding to a value of a desired quantity of tracer is received in box 501 from a surface system. The ejecting of the tracer then starts at box 502. In a preferred embodiment, the starting is performed by opening an electro-valve.

The opening of the electro-valve allows a displacing of the piston actuated for example by a spring. The measuring means provide a measurement of the ejected quantity of tracer, which is proportional to a displacement of the piston. During the ejecting of the tracer, a measured number T2 corresponding to the displacement of the piston, and hence, to the measured ejected quantity of tracer is regularly read at box 503. The measured number T2 is compared in box 505 to the desired number N. If the measured number T2 is smaller than the desired number N, i.e. the measured ejected quantity of tracer is smaller than the value of the desired quantity, then a new value of the measured number T2 is read (in box 503) from the measuring means, thus repeating an ejection cycle.

When the measured number T2 is substantially equal to the desired number N, after a number n of ejection cycles, the ejected quantity of tracer is substantially equal to the desired quantity. The ejection may hence be interrupted at box 506: the electro-valve is closed.

This example algorithm enables to eject a desired quantity of tracer, wherein the value of the desired quantity is received from the surface system at each ejection operation. The value of the desired quantity of tracer may thus be changed, which allows to increase the quantity of ejected tracer for a proper detection of the tracer at the detector tool, or on the contrary, to reduce the quantity and save some tracer.

Furthermore, with an injector tool according to the invention, it is insured that the desired quantity of tracer has really been ejected. The systems from prior art that comprise only a sensor to detect an end of stroke of the piston fail to provide any information about a position of the piston before the ejection, and hence it is only supposed that the piston was at a proper position.

The injector tool according to the invention also allows to measure a duration of the ejecting. The electrical card may comprise a frame counter FRCT, as illustrated in the algorithm of FIG. 5. When the ejecting starts at box 502, the frame counter FRCT is initialized. Then, at each ejection cycle, the frame counter FRCT is incremented in box 504. After n ejection cycles, when the ejecting is interrupted in box 506, the frame counter has been incremented n times. The value of the frame counter FRCT is a function of the duration of the ejecting; it is transmitted at box 507 to the surface system. Knowing the duration of the injecting allows to model a behavior of the ejected tracer within the borehole, and hence to predict a shape of a measured signal at the detector tool. A time at which the ejected tracer is detected may thus be measured more accurately.

The measuring means may be any mean to detect a displacement of a piston relative to a body, and, more generally, any means that provide an evaluating of an ejected quantity of the tracer.

Injector Tool Configuration

Figure 6:
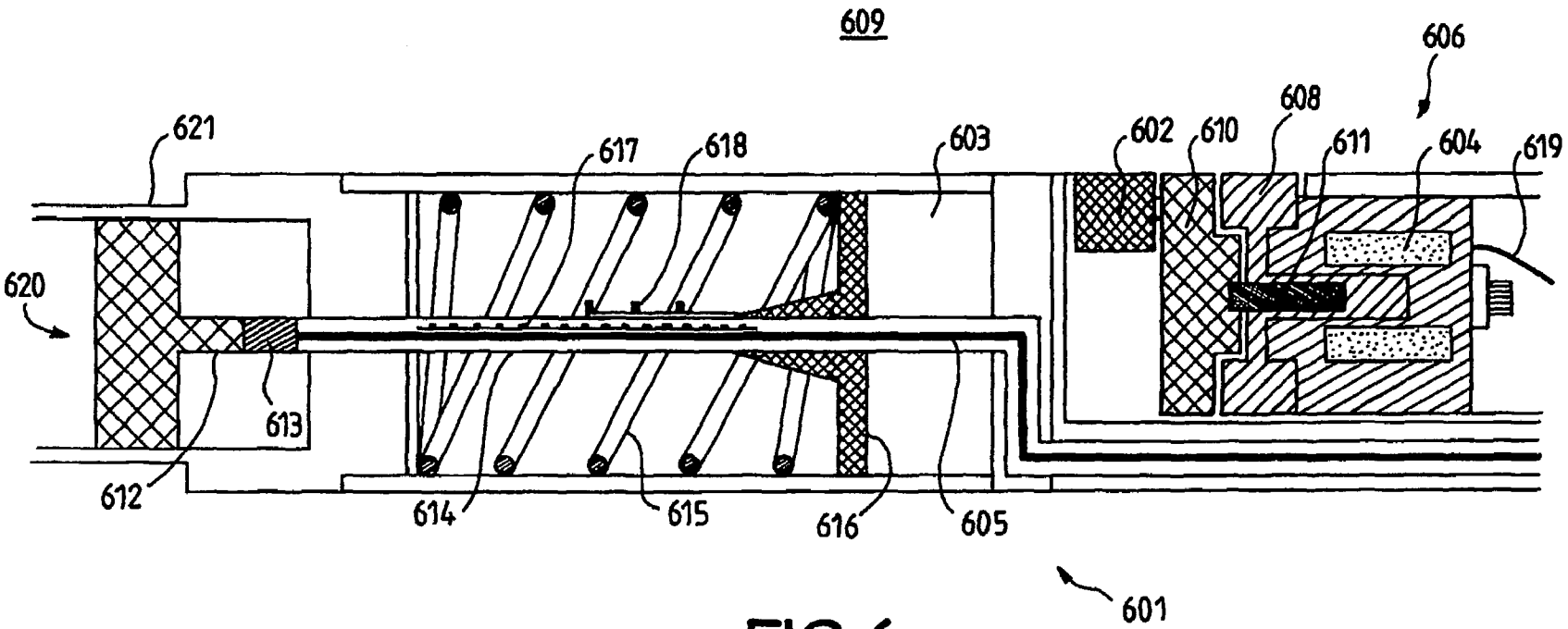
FIG. 6 illustrates an example of a portion of an injector tool according to the present invention.

FIG. 6 illustrates an example of a portion of an injector tool intended to eject a tracer for monitoring a flow of liquid 609 in a well according to the invention. The injector tool 601 comprises a first group of hydraulic parts (603; 610; 616) intended to be in contact with the tracer, and a second group of electrical elements (604; 605; 617). The electrical elements (604; 605; 617) may be any element able to conduct electricity for power or signal transportation, e.g. an electronic card (not represented), Hall Effect sensors 617, etc. The hydraulic parts (603; 610; 616) may be any piece that may be in contact with the tracer, e.g. a reservoir 603, a piston 616, etc. The hydraulic parts (603; 610; 616) of the first group may be accessed and replaced during a maintenance operation. The electrical elements (604; 605; 617) of the second group remain protected during the maintenance operation.

The hydraulic parts (603; 610; 616) of the first group may be directly accessed without cutting electrical wires 605 as in prior art. Furthermore, in a case of a rig site maintenance operation, the electrical elements (604; 605; 617) of the second group remain isolated from contamination by an external fluid in the well even during the maintenance operations, so that they do not need to be replaced. There is hence no need to touch any electrical element (604; 605; 617) of the second group, either for accessing one of the hydraulic parts (603; 610; 616), or for replacing them after a deterioration due to the maintenance operation.

Typically, the injector tool according to the invention comprises an electro-valve 606 that, when opened, allows to expel the tracer. The electro-valve 606 discloses a solenoid seat 610 through which the tracer is expelled, the solenoid seat 610 belonging to the first group. The electro-valve also discloses an electrical portion, e.g. a solenoid coil 604 that is relied to a command wire 619. The solenoid coil 604 is used to control a movement of a plunger 611 and belongs to the second group. The tracer stored in the reservoir 603 passes through a tube (not represented) and is kept in the solenoid seat 610. The movement of the plunger 611 allows the tracer to be expelled.

In the injector tool according to the invention, the electro-valve 606 is oriented so that the solenoid seat 610 is at a peripheral position compared to the solenoid coil 604, i.e. the solenoid seat 610 may be accessed without removing the solenoid coil 604.

Furthermore, the electro-valve 606 may disclose a high pressure barrier 608 that isolates the solenoid coil 604 from the solenoid seat 610. The solenoid coil 604 remains protected when the solenoid seat 610 is replaced.

In the example embodiment illustrated in FIG. 6, it is necessary to remove a seat locker 602 to access the solenoid seat 610.

Similarly, the electrical wires 605 of the injector tool belong to the second group and remain protected during a replacing of the reservoir 603. The electrical wires are located within a chamber 614. The Hall Effect sensors 617 allowing a measurement of a quantity of ejected tracer are also located within the chamber 614. A connector 620 allows to connect the electrical wires with another electronic system, e.g. the electronic card (not represented) of the injector-tool 601, or electrical wires of a second tool (not represented). The connector 620 may comprise a first portion 612 that is mounted on an outside tube 621, and a second portion 613 that is mounted on an inside tube, e.g. the chamber 614.

During the maintenance operation, the first portion 612 of the connector 620 is removed. The second portion 613 of the connector continues to protect the electrical wires 605 and the Hall Effect sensors 617 from the liquid 609 within the well. A spring 615, the piston 616 and the reservoir 603 may hence slide along the chamber 614 so as to be replaced.

By separating the electrical elements and the hydraulic parts, and by protecting the electrical elements, the invention allows to remove and replace the hydraulic parts much more easily than in prior art. Hence corrosive tracers may be used.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. An injector tool for ejecting a tracer in a system for monitoring a flow of liquid within a borehole, the injector tool comprising:

a body;

a piston to expel the tracer;

measuring means comprising at least one magnetic ring mounted on the piston and a plurality of Hall Effect switches mounted on the body, wherein an ejected quantity of the tracer is capable of being determined by measuring a displacement of the magnetic ring mounted on the piston relative to the switches mounted on the body.

2. An injector tool according to claim 1, wherein three magnetic rings are mounted on the piston;

the Hall Effect switches are organized into four independent arrays; and the Hall Effect switches belonging to a determined array are tied to a single determined wire.

3. An injector tool according to claim 1, further comprising:

a reservoir into which the tracer is stored;

an opening through which the tracer may be ejected from the injector tool;

an electro-valve to control the opening;

actuating means to move the piston such that the piston moves when the electro-valve opens the opening and the tracer is ejected.

4. An injector tool according to claim 1, the injector tool comprising:

a first group of hydraulic parts intended to be in contact with the tracer;

a second group of electrical elements;

wherein the hydraulic parts of the first group may be accessed and replaced during a maintenance operation; and wherein the electrical elements of the second group remain protected during the maintenance operation.

5. An injector tool according to claim 4, further comprising an electro-valve, the electro-valve comprising:

an electrical portion belonging to the second group;

a solenoid seat belonging to the first group;

a high pressure barrier for isolating the electrical portion of the electro-valve from the solenoid seat;

wherein the electro-valve is mounted in the injector tool such that the solenoid seat may be accessed without removing the electrical portion.

6. An injector tool according to claim 4, further comprising electrical wires belonging to the second group;

a connector allowing to connect the electrical elements of the second group with other electrical elements of a distinct tool, the connector comprising a first portion and a second portion, wherein the first portion may be removed during the maintenance operation and wherein the second portion continues to protect the electrical wires during the maintenance operation.

7. A tool system for monitoring a flow of liquid within a borehole comprising:

a plurality of tools disposed on a longitudinal axis of the tool system, the plurality of tools comprising at least a first injector tool according to claim 1 for ejecting in the borehole a tracer and a detector tool to detect the ejected tracer;

a standard digital bus traversing at least a portion of each tool of the plurality of tools, the standard digital bus allowing a communication between each tool of the plurality of tools.

8. The tool system of claim 7, wherein the plurality of tools comprises a control tool to manage data exchanges through the standard digital bus.

9. The tool system of claim 7, wherein the plurality of tools comprises the first injector tool and a second injector tool, the second injector tool being located on an opposite side of the detector tool of the tool system as compared to the first injector tool so as to allow to detect a possible reverse flow in the borehole.

10. The tool system of claim 7, wherein the plurality of tools comprises the first injector tool and a second injector tool distinct from the first injector tool, the second injector tool being located on the same side of the detector tool in the tool system as the first injector tool.

11. The tool system of claim 7, wherein the borehole has a longitudinal direction that is substantially horizontal;

the plurality of tools also comprises an orientating tool to measure an orientation of at least an ejection port of the first injector tool.

12. The tool system of claim 7, wherein the first injector tool comprises a first group of electrical wires corresponding to the standard digital bus and at least one standard connector allowing to removably connect the first group of electrical wires to a second group of electrical wires corresponding to the standard digital bus within a distinct tool from the plurality of tools.

13. The tool system according to claim 12, wherein both the first group of electrical wires and the second group of electrical wires comprise two power wires dedicated to power transportation and two signal wires dedicated to signal transportation.

* * * * *